US008811450B2

(12) United States Patent
Mortimer et al.

(10) Patent No.: US 8,811,450 B2
(45) Date of Patent: Aug. 19, 2014

(54) INTEGRATED PROCESS CONTROL SYSTEM FOR ELECTRIC INDUCTION METAL MELTING FURNACES

(75) Inventors: John H. Mortimer, Little Egg Harbor Township, NJ (US); Peter Aruanno, Hammonton, NJ (US); Emad Tabatabaei, Voorhees, NJ (US); Satyen N. Prabhu, Voorhees, NJ (US)

(73) Assignee: Inductotherm Corp., Rancocas, NJ (US)

( * ) Notice: Subject to any disclaimer, the term of this patent is extended or adjusted under 35 U.S.C. 154(b) by 1378 days.

(21) Appl. No.: 12/100,913

(22) Filed: Apr. 10, 2008

(65) Prior Publication Data

US 2008/0251233 A1 Oct. 16, 2008

Related U.S. Application Data

(60) Provisional application No. 60/910,916, filed on Apr. 10, 2007.

(51) Int. Cl.

| | |
|---|---|
| ***F27D 3/00*** | (2006.01) |
| ***H05B 6/02*** | (2006.01) |
| ***F27B 3/28*** | (2006.01) |
| ***F27D 3/15*** | (2006.01) |
| ***F27D 19/00*** | (2006.01) |
| ***F27D 21/00*** | (2006.01) |

(52) U.S. Cl.

CPC ..... *F27B 3/28* (2013.01); *F27D 3/1563* (2013.01); *F27D 19/00* (2013.01); *F27D 21/00* (2013.01)

USPC ..... 373/142; 373/138; 373/143

(58) Field of Classification Search

USPC ..... 373/84, 142, 143, 156, 138, 139, 144; 164/493; 266/135, 200, 242, 78, 96, 266/227, 265

See application file for complete search history.

(56) References Cited

U.S. PATENT DOCUMENTS

| | | | | |
|---|---|---|---|---|
| 3,554,143 | A * | 1/1971 | Rodgers et al. | 110/222 |
| 4,008,884 | A | 2/1977 | Fitzpatrick et al. | |
| 4,525,665 | A * | 6/1985 | Smalley | 324/522 |
| 4,745,620 | A * | 5/1988 | Mortimer | 373/152 |
| 4,771,991 | A | 9/1988 | Sankaran | |
| 5,301,863 | A * | 4/1994 | Prinz et al. | 228/33 |
| 6,165,411 | A * | 12/2000 | Adachi et al. | 266/135 |
| 7,109,111 | B2 | 9/2006 | Wang et al. | |
| 2002/0088102 | A1 * | 7/2002 | Stercho | 29/401.1 |
| 2003/0122290 | A1 | 7/2003 | Wunsche | |
| 2008/0058981 | A1 | 3/2008 | Andretsch et al. | |

FOREIGN PATENT DOCUMENTS

| | | | |
|---|---|---|---|
| CN | 1600521 | A | 3/2005 |
| DE | 102004045357 | A1 | 4/2005 |
| TW | 200538216 | A | 12/2005 |

* cited by examiner

*Primary Examiner* — Henry Yuen
*Assistant Examiner* — Hung D Nguyen
(74) *Attorney, Agent, or Firm* — Philip O. Post

(57) ABSTRACT

An integrated process control installation is provided for electric induction metal melting furnaces with variable furnace states. The integrated process control installation can include supporting charge delivery and slag removal installations, and furnace process operations for process control of melting metal in the furnaces. The variable furnace states, supporting installations, and furnace process operations are controlled by a supporting processing installation, while a robotic apparatus performs the furnace process operations.

13 Claims, 8 Drawing Sheets

INTEGRATED PROCESS CONTROL SYSTEM FOR ELECTRIC INDUCTION METAL MELTING FURNACES

CROSS REFERENCE TO RELATED APPLICATIONS

This application claims the benefit of U.S. Provisional Application No. 60/910,916, filed Apr. 10, 2007, which is hereby incorporated by reference in its entirety.

FIELD OF THE INVENTION

The present invention relates to integrated process control apparatus, installations and systems for electric induction metal melting furnaces that produce molten metal by electric induction heating and melting of metal charge for use in industrial processes.

BACKGROUND OF THE INVENTION

Production of molten metal by electric induction melting typically involves the continuous operation of one or more induction furnaces in which metal charge is inductively heated and melted. The process requires the performance of a number of operations, including process steps and monitoring functions. For example, metal charge must be added to each furnace as molten metal is drawn from each furnace. New charge must be delivered to each furnace. Slag must be removed from each furnace as the induction melting process progresses. Temperature of the molten metal in each furnace must be periodically measured and analyzed to determine if the temperature is in an acceptable range. Samples of the molten metal in each furnace must be periodically taken and analyzed to determine if the metal chemistry is acceptable. Trim materials may need to be added to the molten metal in each furnace to alter the chemistry of the molten metal.

One object of the present invention is to provide an integrated process control installation for electric induction metal melting furnaces wherein at least most of the process operations are controlled by a coordinated and integrated process control system and with the benefit of robotic apparatus.

BRIEF SUMMARY OF THE INVENTION

In one aspect the present invention is an integrated process control system or installation for electric induction melting furnaces comprising one or more electric induction melting furnaces where each of the furnaces has one or more variable furnace states; one or more charge delivery installations where each of the charge delivery installations has one or more variable charge delivery states; one or more slag removal installations where each of the slag removal installations has one or more variable slag removal states, one or more furnace process operations for process control of a molten metal bath in each one of the one or more furnaces, where each one of the one or more furnace process operations has one or more variable furnace melt process states, at least one robotic apparatus for execution of one or more of the one or more furnace melt process; and one or more control processors for controlling the one or more variable states of the one or more furnaces, the one or more charge delivery systems, and the one or more slag removal systems.

In another aspect the present invention is a method or process of producing molten metal from one or more electric induction furnaces. In the process an integrated process controller controls one or more variable furnace states of each of the furnaces, one or more variable charge delivery states of a charge delivery installation, one or more variable slag removal states of a slag removal installation, and a robotic apparatus that performs one or more furnace process operations.

The above and other aspects of the invention are set forth in this specification and the appended claims.

BRIEF DESCRIPTION OF THE DRAWINGS

The foregoing brief summary, as well as the following detailed description of the invention, is better understood when read in conjunction with the appended drawings. For the purpose of illustrating the invention, there is shown in the drawings exemplary forms of the invention that are presently preferred; however, the invention is not limited to the specific arrangements and instrumentalities disclosed in the following appended drawings.

DETAILED DESCRIPTION OF THE INVENTION

In some examples of the invention, the integrated process control system can have a selectable manual or fully automatic mode. The following example of the invention includes a selectable manual or fully automatic mode. In manual mode, individual furnace melt processes may be executed automatically by the robotic apparatus, upon manual input by a human operator. In some examples of the invention, in manual mode, individual furnace melt processes executed automatically by the robotic apparatus may be interrupted by the human operator for additional manual inputs. In other examples of the invention the control system may operate only in a fully automatic mode.

One or more suitable manual input control devices can be provided for operation in the manual mode as further described below. The manual input control devices may be hardwired to input/output (I/O) devices of the integrated process control system and permanently located in one of the control processors used in the present invention, or alternatively, wirelessly connected to the I/O devices of the integrated process control system to allow the human operator of the manual input control devices to move about while operating the devices.

Figure 1:
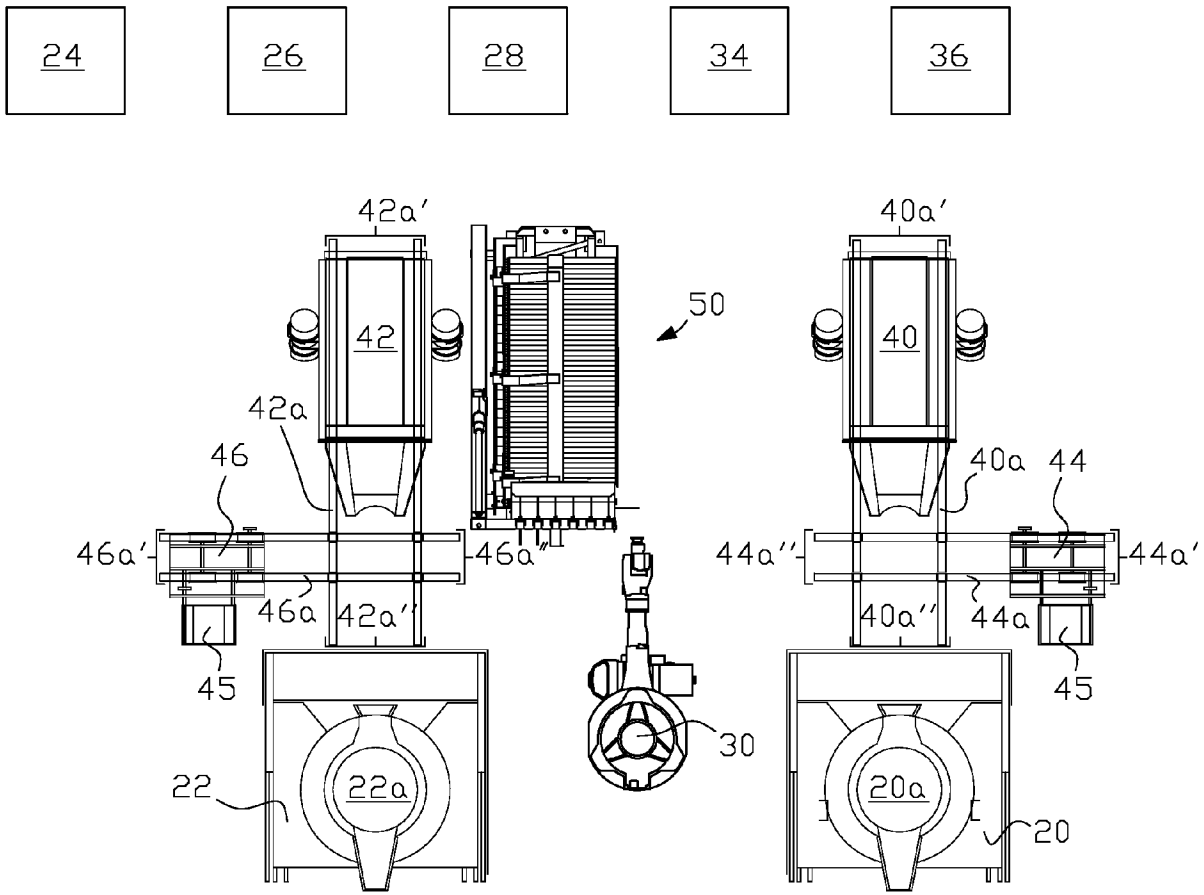
FIG. 1 is one example of a simplified diagrammatic layout of one example of electric induction metal melting furnace equipment associated with the integrated process control installation of the present invention.

FIG. 1 illustrates an exemplary, non-limiting arrangement of the principal components associated with the electric induction metal melting furnaces associated with the integrated control process installation of the present invention. Two electric induction furnaces 20 and 22 are serviced by single robotic apparatus 30. A suitable, but non-limiting, robotic apparatus is KR 240-2 F (Series 2000) available from KUKA Roboter GmbH, Augsburg, GERMANY. Robotic apparatus 30 selectively grips one or more tools, as further described below, that can be stored on integrated tool and transport apparatus 50. Charge cars 40 and 42 supply metal charge to furnaces 20 and 22 respectively, by bringing charge (for example, metal ingots or scrap metal) to each furnace as further described below. In some examples of the invention, slag carts 44 and 46 remove slag (waste material) from the furnace operating space, after the robotic apparatus places slag from a bath (molten metal in a furnace) on a cart, as further described below.

Figure 4:
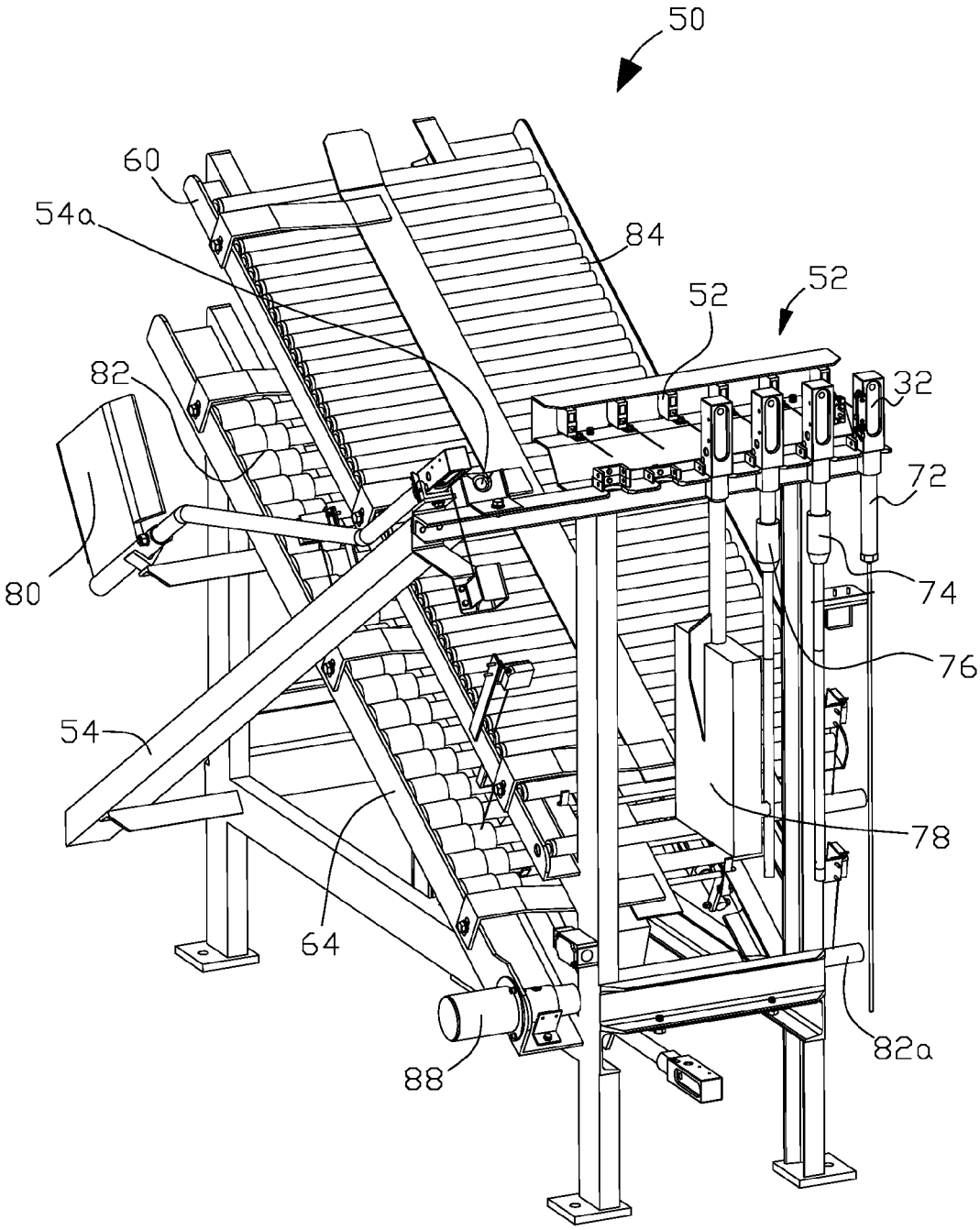
FIG. 4 is an isometric view of one example of an integrated tool and transport apparatus used with one example of the integrated process control installation of the present invention.
Figure 5:
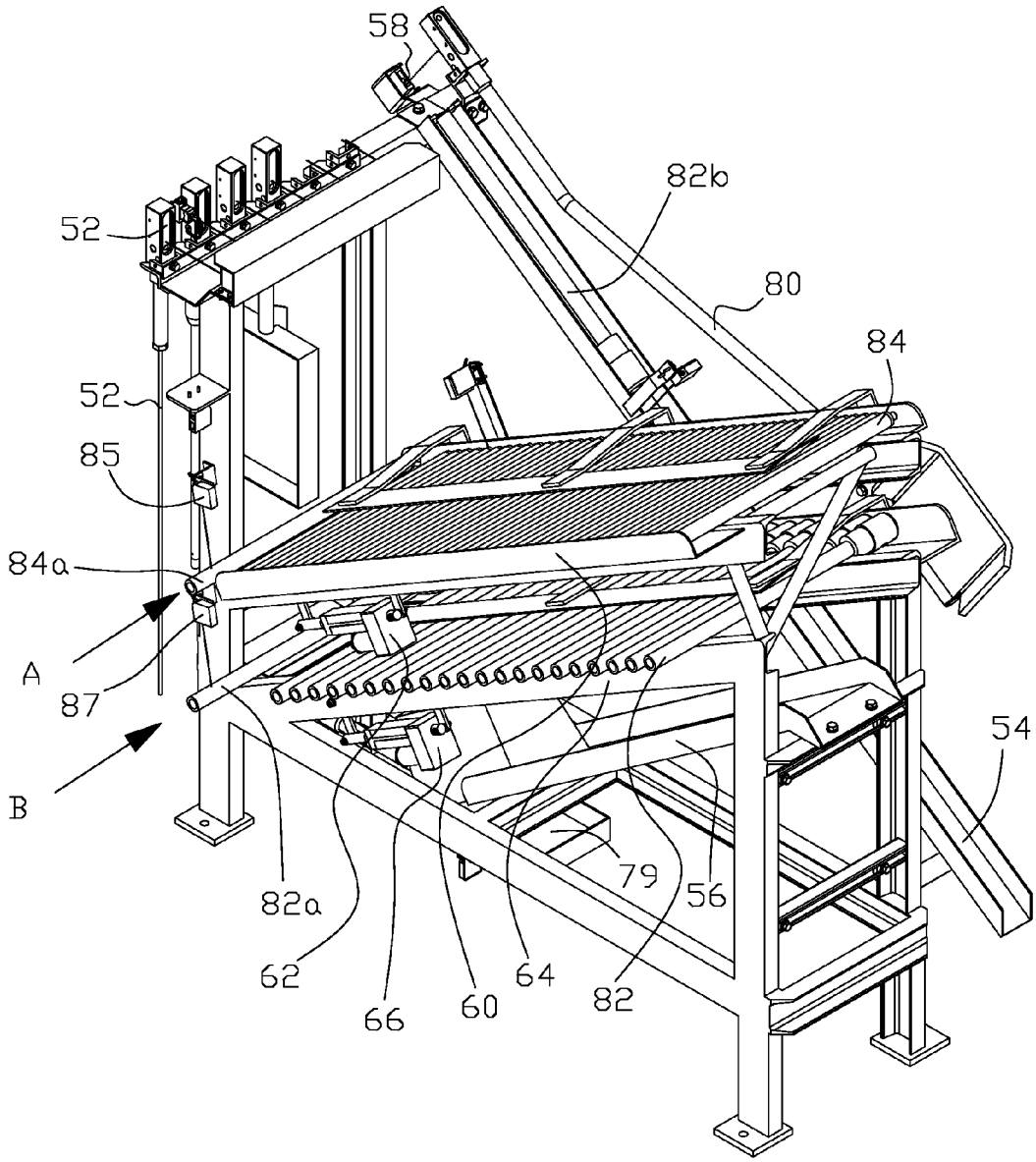
FIG. 5 is another isometric view of the integrated tool and transport apparatus shown in FIG. 4.
Figure 6:
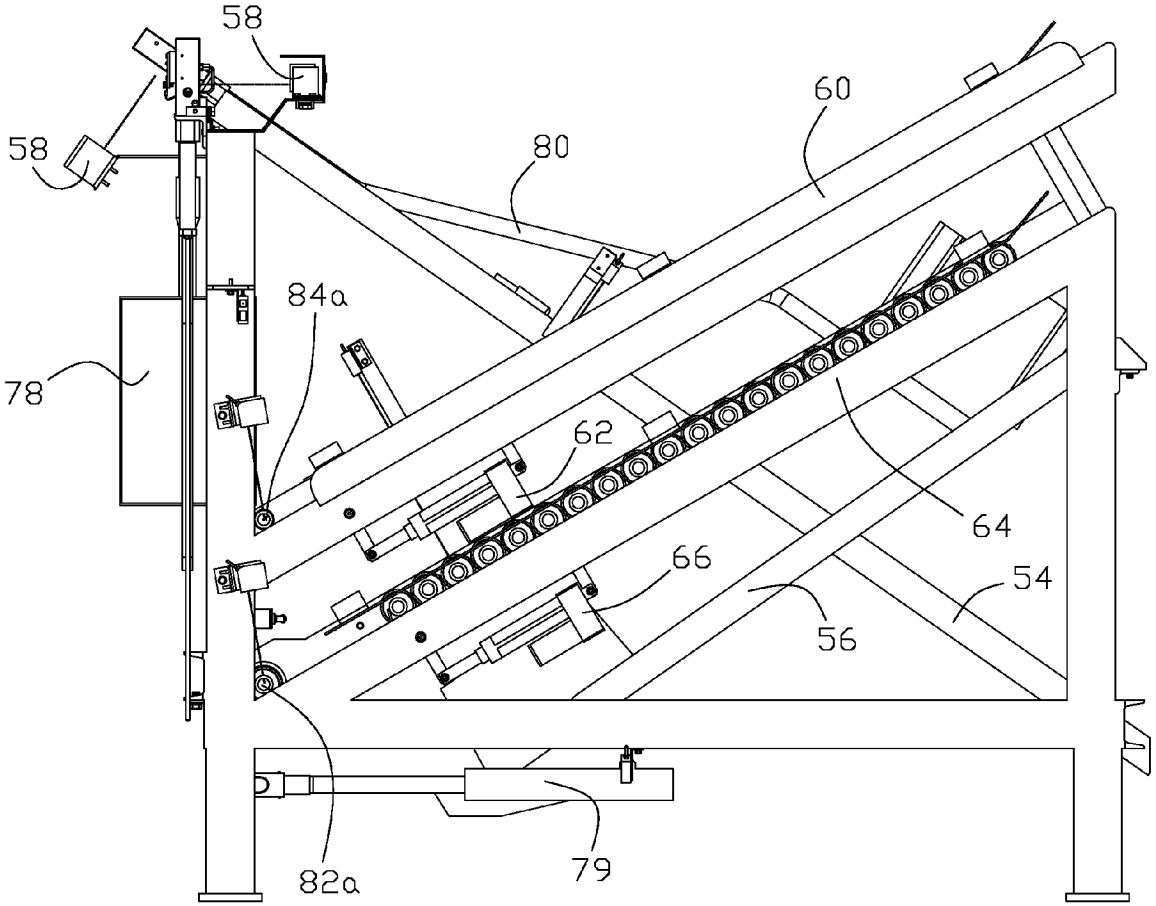
FIG. 6 is a side elevation view of the integrated tool and transport apparatus shown in FIG. 4 and FIG. 5

Integrated tool and transport apparatus 50 is best seen in FIG. 4, FIG. 5 and FIG. 6. Multiple tool holder 52 serves as a storage device for various tools, which in this non-limiting example, comprise grounding tool (probe) 72, metal sampler immersion tool (lance) 74, temperature probe immersion tool (lance) 76, and slag coagulant tool (pan) 78. Stored on a separate storage device on apparatus 50 is slag tool (pan) 80 for collection of slag from a bath of molten metal in a furnace. In some examples of the invention, the slag coagulant tool and slag tool may be combined into a single slag/slag coagulant tool. Also stored on a separate storage device on apparatus 50 is trim materials tool (pan) 79. The end of each tool terminates in a robotic apparatus standard interface element 32 that allows the robotic apparatus to grip the tool by the standard interface element. If required, electrical connections, or other auxiliary service connections, such as a compressed air supply line, associated with a tool, as further described below, can be connected to the robotic apparatus via the standard interface element associated with the tool. One or more position sensors 58 can be provided on apparatus 50 to sense whether a tool is in its proper stored position on apparatus 50. Sensed proper position of a tool can be a permissive true condition state prior to the robotic apparatus executing any movements to grip the tool from its stored position. Apparatus 50 can also include storage for a plurality of metal samplers 82 and temperature probes 84. Apparatus 50 can also include transport structures, for example, combination metal sampler and thermocouple probe chute 54 to deliver a filled metal sampler or used thermocouple probe from the furnace operating space, and trim materials chute 56 to deliver trim materials to the furnace operating space. Not shown in the figures is a slag coagulant chute for delivering slag coagulant to the furnace operating space as further described below; in other examples of the invention, the slag coagulant chute can be in incorporated into apparatus 50.

The above equipment for the electric induction melting furnaces can be isolated in a contained furnace operating (foundry) space separate from the following integrated process control equipment: robotic apparatus processor controller (robot processor) 34; robotic apparatus remote controller (robot remote) 36; furnace equipment control processor (furnace equipment processor) 24; furnace performance control processor (furnace performance processor) 26 and integrated system supervisory control processor (supervisory processor) 28. Electric power equipment for powering the electric induction furnaces, including induction coils for heating and melting metal placed in the furnaces, and associated equipment is suitably located, for example, in an area beneath the foundry space (not shown in the figures). A suitable but non-limiting furnace performance processor is MELTMINDER® available from Inductotherm Corp., Rancocas, N.J., USA. Generally robot remote 36 comprises equipment for a human operator to interface with the robotic apparatus, for example, by inputting desired movements of the robotic apparatus when the robotic apparatus is not operating in an automatic mode (that is, automatic individual furnace melt processes, or fully automatic operation), or when manual override is available in an automatic mode. Generally the robot processor 34 comprises computer processing equipment for control of the robotic apparatus. Generally the furnace equipment processor 24 comprises equipment for input of manual control of furnace equipment when the integrated process control system is not operating in automatic mode. Generally the furnace performance processor 26 comprises equipment for overall monitoring and control of the electric induction metal melting process. Generally the supervisory processor 28 comprises computer processing equipment for overall supervisory control of the integrated process control installation of the present invention. While the integrated process control equipment are diagrammatically represented as individual components in the drawings, one or more of these components may be combined into other configurations of multiple components, or a single integrated control processor, in some examples of the invention. The terms "processor" and "computer processing equipment" as used herein can include computer processors, input and output devices required to communicate with the processors when executing the integrated process control computer program, storage devices to electronically store computer programs, data and additional information, as required to execute the integrated process control computer program; and remote communication interfaces for electronic transfer of data between the integrated process control system and a remote location where, for example, the integrated process control system could be remotely evaluated or operated. The term "integrated process control computer program" is used below, for convenience, to include a plurality of computer programs residing in one or more electronic storage devices and being executed simultaneously, independently, and/or coordinately by one or more control processors communicating, as may be necessary, among the processors and the equipment associated with the electric induction furnaces to perform the integrated process control described herein.

Figure 3:
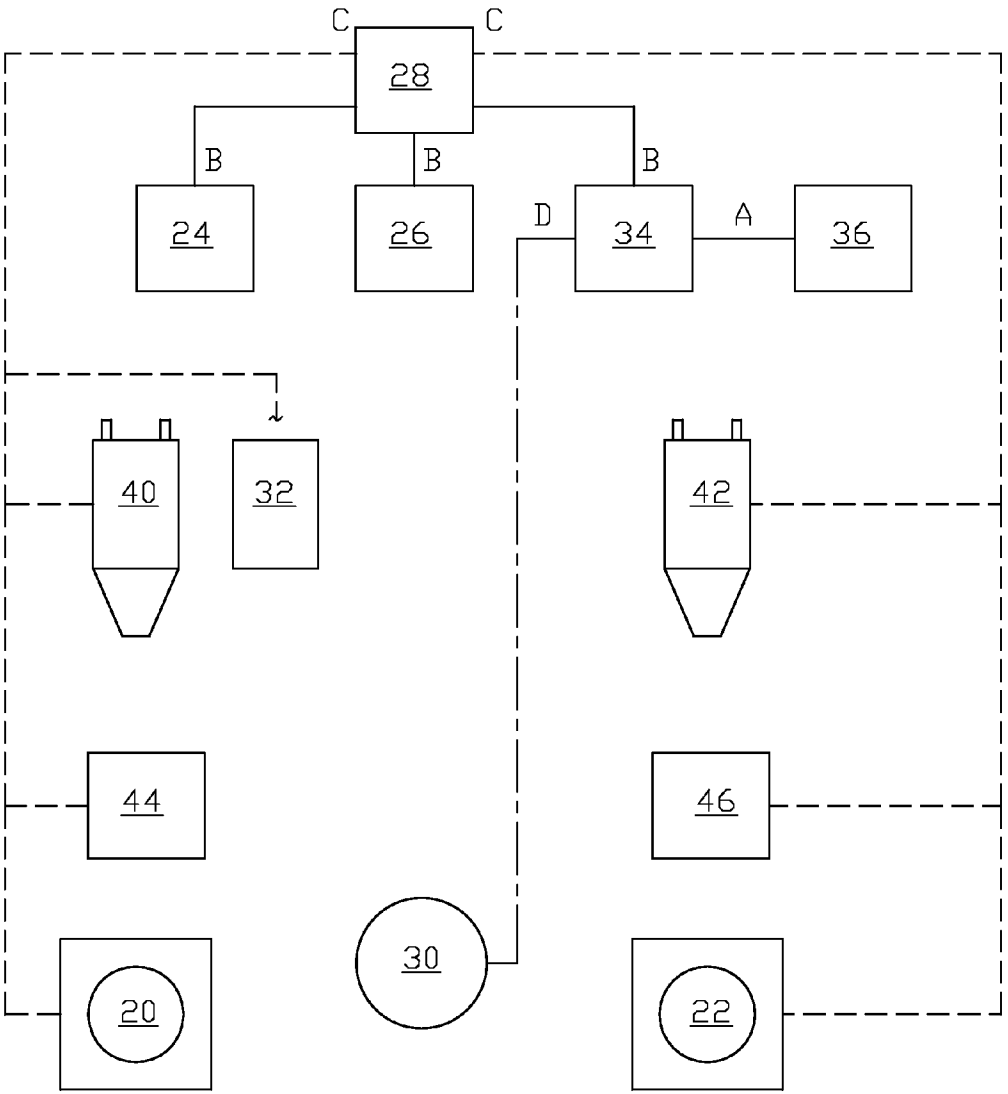
FIG. 3 is a simplified interconnection diagram of one example of the integrated process control installation of the present invention.

FIG. 3 illustrates one non-limiting example of the communication links among the various components of an integrated process control system of the present invention. Robot remote 36 can provide a means for remote manual control of robotic apparatus 30 and has communications link A with robot processor 34 that can process inputs from robot remote 36 and forward appropriate signals to robotic apparatus 30 for execution of robotic movements by communications link D. In some examples of the invention, robotic apparatus 30 may include a self-contained, onboard control processor, or a local processor, that shares data storage and program execution with robot processor 34. Robot processor 34, furnace performance processor 26 and furnace equipment processor 24 have communications links B with supervisory processor 28, which, for example, may be a programmable logic controller. The supervisory processor has communications links C with equipment for the electric induction melting furnaces as required to control the equipment according to the furnace induction melt processes. In automatic mode, supervisory processor 28 executes overall supervisory control of the furnace equipment processor 24, furnace performance processor 26 and robot processor 34 via communications link B. Any of the communications links may be a combination of hardwired or wireless, one-way or two-way, digital or analog, as applicable to a particular application.

Although the exemplary robotic apparatus used in the below example of the invention is configured as a non-ambulatory, articulated arm with six degrees of freedom and a mechanical gripper (hand), the robot in other examples of the invention may consist of different configurations. For example, in other examples of the invention, the robotic apparatus may be ambulatory, either guided, for example, on a rail, or may further comprise a mobility subsystem controlled by the integrated process control system of the present invention that permits the robotic apparatus to move about the furnace operating space in a controlled pattern. In other examples of the invention, a singular robotic apparatus may have more than one independently controlled articulated arms, or multiple robotic apparatus may be used.

In the present non-limiting example of the invention, induction furnace melt operations or processes can include a slag removal process, grounding check process, temperature check process, metal sampling process, and trim material addition process, as further described below.

Figure 2:
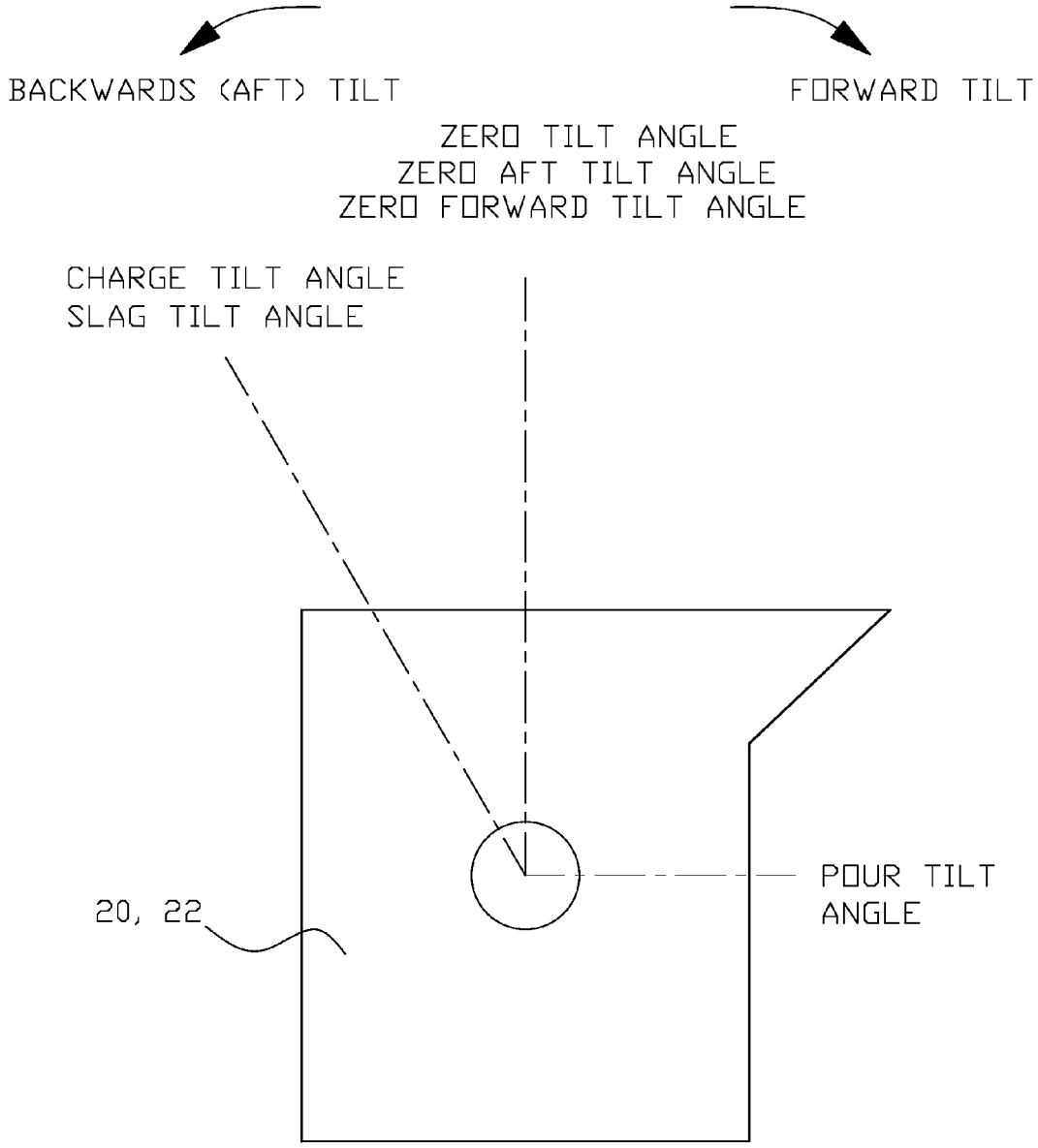
FIG. 2 is a diagrammatic illustration of furnace tilt state variables for furnaces used in one example of the integrated process control installation of the present invention.

Furnace state variables, or variable furnace states, in this non-limiting example of the invention are furnace tilt angle and lid position. Each of the one or more electric induction furnaces is a tilt furnace with a lid. Each furnace can be tilted forward (fwd) or backwards (aft), and the lid can be opened or closed by means of suitable actuators, such as electric or hydraulic actuators. Furnace 20 or 22 tilt angles, as used below, are diagrammatically described in FIG. 2.

In this non-limiting example of the invention, a furnace's home position is defined as: forward zero tilt angle; aft zero tilt angle; and lid closed. A furnace "return home" command is executed sequentially by the integrated process control system as follows: lid closure; furnace rotation to aft zero tilt angle; and then furnace rotation to forward zero tilt angle.

In the non-limiting dual furnace arrangement shown in FIG. 1, one of the two furnaces is selected as the active furnace for manual mode, and the active furnace state is a permissive condition state for furnace melt processes as further described below.

In other examples of the invention, the furnace may not tilt, and/or may not have a lid; any type of electric induction furnace, including vacuum electric induction furnaces and cold crucible induction furnaces, for example, can be used in the present invention. For the tilt furnaces in the present example, furnace state variables are defined as tilt angle and lid position. Other types of electric induction furnaces can have different variable furnace states that define variable states of the furnace controlled by the integrated process control system of the present invention. For example, the induction furnace may be a lift-out crucible furnace where metal is melted and processed in a crucible that is lifted out of the furnace for pouring of molten metal. For that example of the invention, crucible location (that is, in the induction furnace or removed from the induction furnace) is a variable furnace state, and a furnace melt operation or process is pouring of molten metal from the removed crucible, which could be accomplished by robotic apparatus 30 gripping a crucible holding tool for lifting the crucible from the furnace and pouring molten metal from the removed crucible.

In the present example of the invention, for manual control (mode), each furnace is provided with a suitable input control device, such as a combination joystick and selector switch, for use by a human operator. The input control device can be located on furnace equipment processor 24. The joystick can output signals to supervisory processor 28, which outputs signals for control of the actuators to move a furnace between tilt positions, and the selector switch can output signals for control of the actuators to open and close the lid of a furnace, when a furnace is selected as the active furnace. In fully automatic mode, signals from the manual input control device are inhibited and supervisory processor 28 controls the furnace state variables.

To enable forward tilt (up or down), true condition states must be furnace at aft zero tilt angle and lid closed. To enable aft tilt up, true condition state must be furnace at forward zero tilt angle; to enable aft tilt down, true condition state must be furnace at the active furnace's charge car at home position as defined below. To enable lid opening, the true condition state must be furnace at forward zero tilt angle.

Variable charge delivery states for the charge delivery installation or system in this non-limiting example of the invention include position of a charge car as further described below. In this non-limiting example of the invention, the charge delivery system includes a charge car dedicated to each of the furnaces. A typical, but non-limiting, example of a charge car is similar to a vibratory conveyor with side-mounted drivers as taught in U.S. Pat. No. 6,041,915, with the addition of a transport system to move (index) the charge car to the furnace ("at furnace" position) and away from the furnace ("away from furnace" position). In the present non-limiting example of the invention, bi-rails 40*a* and 42*a* are used for process controlled movement of charge cars 40 and 42, respectively, each of which is mounted on a four wheel carriage (transport system). Variable charge delivery states may be different in other examples of the invention. For example a moveable chute may be used to deliver charge to a furnace, and the position of the chute may be a variable state.

In FIG. 1 each charge car is shown in its home position (away from furnace) at ends 40*a*' and 42*a*' of bi-rails 40*a* and 42*a* respectively. In the charge car home position, the integrated process control system may include automatic charge supply apparatus that, for example, delivers charge to an empty charge car in the home position from a suitable supply source, such as a bottom opening hopper. A charge car's furnace charging position (at furnace) is defined as charge car 40 or 42 being at end 40*a*" or 42*a*" of bi-rails 40*a* or 42*a* respectively.

In the present example of the invention, for manual control (mode), a suitable charge car input control device, such as a combination joystick and selector switch, can be provided for each charge car for use by a human operator. The input control device can be located on furnace equipment processor 24. The joystick can output signals to supervisory processor 28, which outputs signals to the controller of a wheel drive motor mounted on the charge car for indexing the charge car, and the selector switch can output signals for vibrating the charge car to cause charge located on the charge car's conveyor to move into the furnace when the charge car is in the "at furnace" position. In fully automatic mode, signals from the manual input control device are inhibited and supervisory processor 28 controls the charge delivery system state variables.

For a charge car to perform any function, the charge car's associated furnace must be selected as the active furnace. For a charge car to index towards the active furnace the following states must be true: furnace at aft charge tilt angle; lid open; active furnace's slag cart at home position (as shown in FIG. 1 and further described below); robotic apparatus 30 not currently executing a furnace melt operation or process. For a charge car to initiate execution of the charge process (that is, vibrating the conveyer loaded with charge on the charge car), the charge car must be in the charging (at furnace) position.

Variable slag removal states for the slag removal installation or system in this non-limiting example of the invention include position of a slag cart as further described below. In this non-limiting example of the invention, the slag removal installation or system includes a slag cart dedicated to each of the furnaces.

In the present example of the invention, for manual control (mode), a suitable slag cart input control device, such as a joystick, can be provided for each slag cart for use by a human operator to index a slag cart towards or away from a furnace. The slag cart input control device can output signals to the supervisory processor 28, which outputs signals to the controller of a wheel drive motor mounted on the slag cart for indexing the slag cart to and from a furnace. In fully automatic mode, signals from the manual input control device are inhibited and supervisory processor 28 controls the slag removal system state variables.

In FIG. 1 each slag cart is shown in its home position (away from furnace) at ends 44*a*' and 46*a*' of bi-rails 44*a* and 46*a* respectively. In the slag cart home position, slag pan 45, which is mounted on each slag cart, may automatically rotate to a dump position to dispose of slag on the pan into a disposal chute or container. In other examples of the invention, rotation of the slag pan may be a variable slag removal state that is controlled by the integrated process control system. A slag cart's slagging (at furnace) position is defined as slag cart 44 or 46 being at end 44*a*" or 46*a*" of bi-rails 44*a* or 46*a* respectively.

In the present non-limiting example of the invention, for manual control (mode) of a slag removal process, the human operator initiates the slag removal process by a suitable manual input control device, such as a pushbutton on furnace equipment processor 24 that outputs a signal to supervisory processor 28. For a fully automatic slag removal process, signals from the manual input control device are inhibited and supervisory processor 28 controls the variable slag removal states. For a slag cart to perform any function, the slag cart's associated furnace must be selected as the active furnace. For a slag cart to index toward the active furnace, a true condition state is that the charge car associated with the active furnace be in its home position as described above.

For execution of a slag removal operation or process, the following condition states must be true: active furnace at aft slag tilt angle; lid open; and active furnace's slag cart in slagging position as defined above.

In this non-limiting example of the invention, the slag removal process can be taught to robotic apparatus 30 as follows. After the robotic apparatus executes movements required to grip slag tool 80 on integrated tool and transport apparatus 50, which movements are controlled by instructions from the integrated process control system, the human operator will control movement of the slag tool gripped by the robotic apparatus with a manual input control device on robot remote 36 when dipping into the bath (molten metal in the furnace) to gather and capture slag on the slag tool 80 and deposit the slag onto slag pan 45 on the appropriate slag cart at the active furnace. Robot processor 34 can electronically store the motions of the robotic apparatus during the taught slag removal process, and will execute the electronically stored movements during the next slag removal process for the taught furnace, subject to override during at least some period of the next slag removal process by the human operator at robot remote 36. Robot processor 34 will electronically store the inputted override movements, and execute them, along with the previously stored non-overridden movements, during the next slag removal process for the taught furnace. In this manner robotic apparatus 30 adaptively learns to automatically execute a slag furnace process for particular furnace parameters, such as the location of the surface level of a bath in the furnace. Robotic apparatus 30 will execute an entire slag removal process, as taught, or by execution of the stored computer program and can pause for an input from the human operator before returning the slag tool 80 to integrated tool and transport apparatus 50. The human operator's choice of manual inputs can include "terminate slagging process" or "start slagging process" for execution of another slag removal process. The manual inputs may be made at furnace equipment processor 24. Responsive to a "terminate slagging process" input, robotic apparatus 30 executes programmed movements to return slag tool 80 to apparatus 50 and can then pause for the next manual input when in manual mode. Responsive to a "start slagging process" input, robotic apparatus 30 executes a slag removal process for the active furnace as previously described above.

Figure 7:
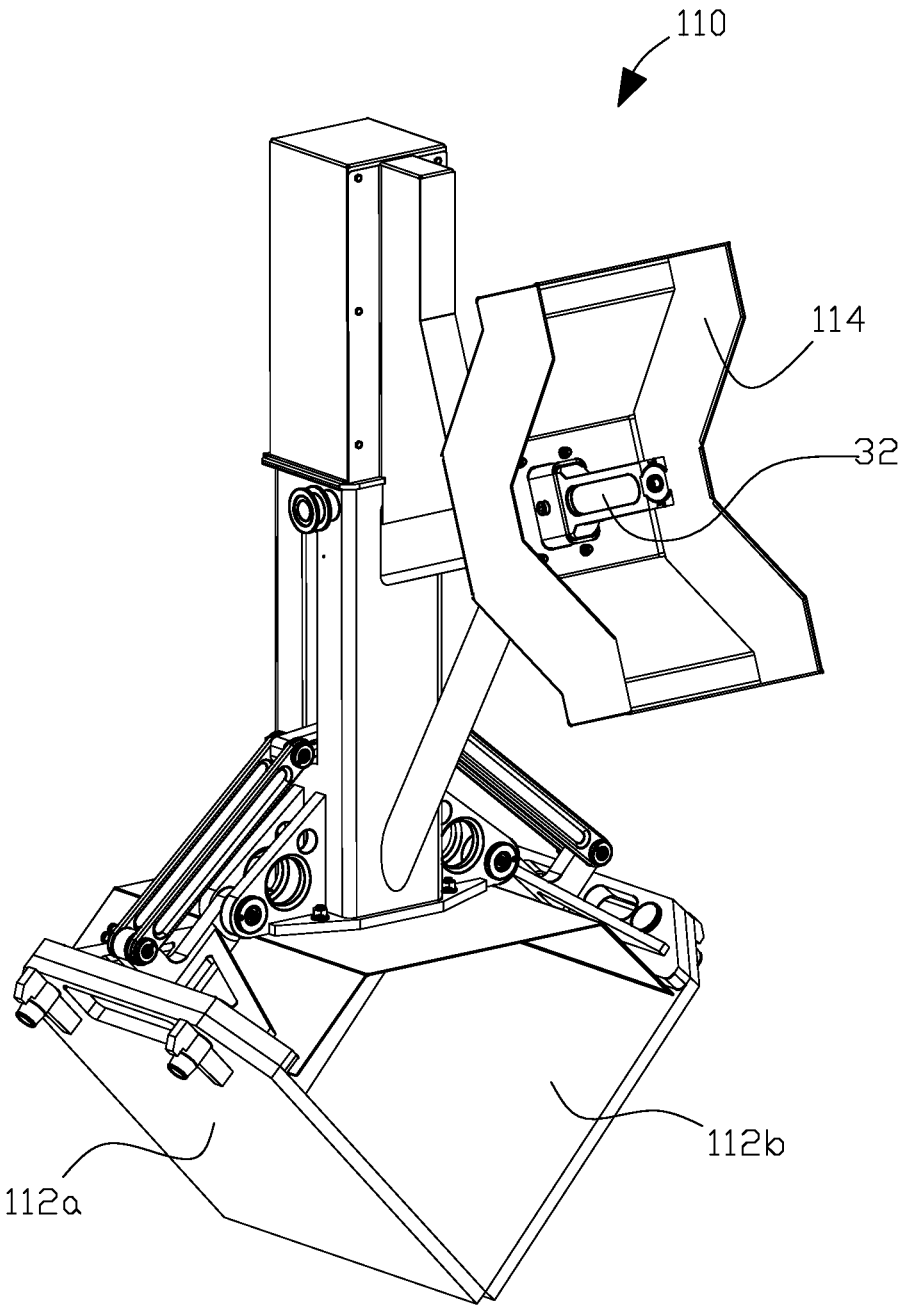
FIG. 7 is an isometric view of one example of a slag skimmer tool used in one example of the integrated process control installation of the present invention.
Figure 8:
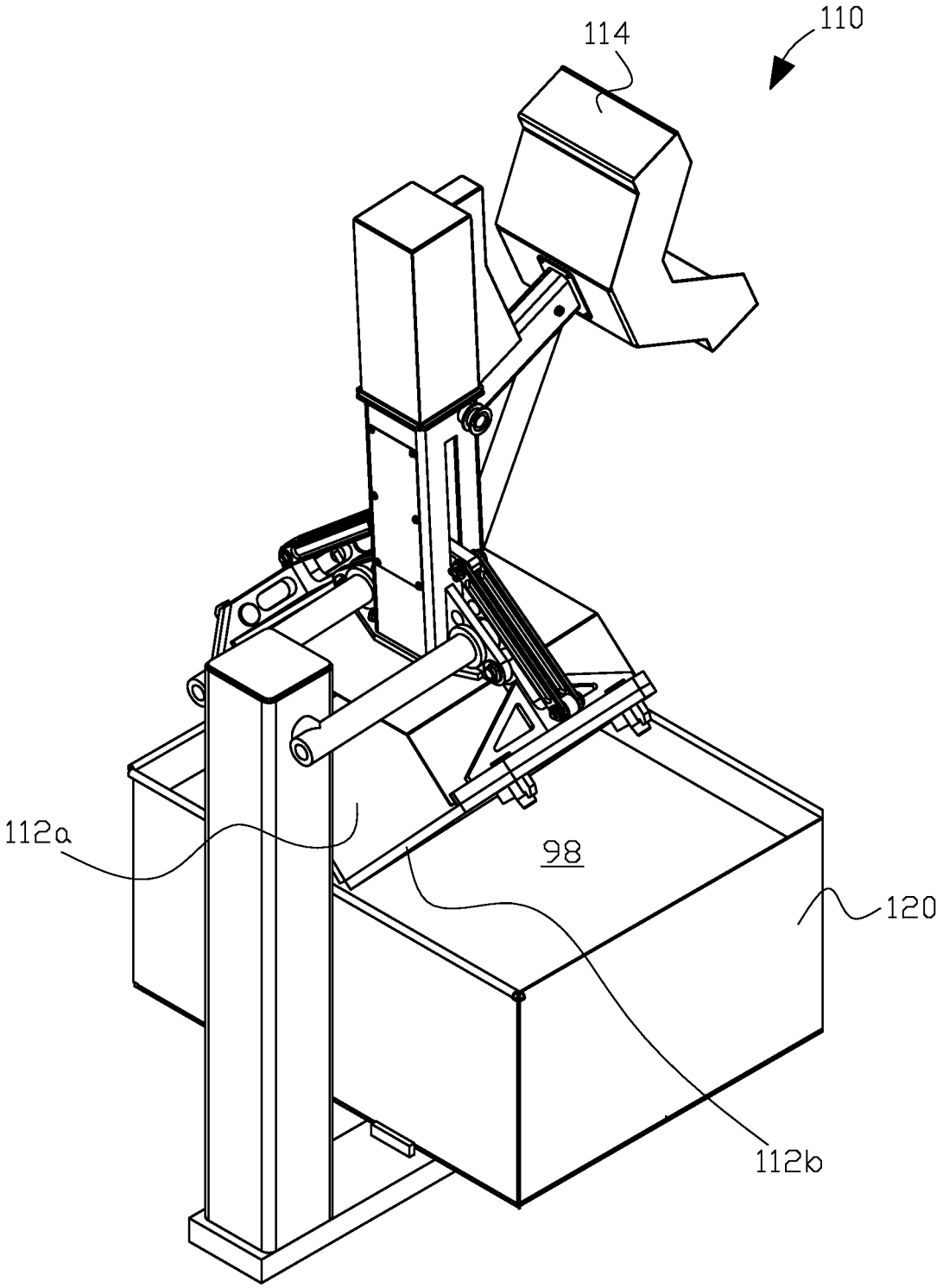
FIG. 8 is an isometric view of one example of the slag skimmer tool shown in FIG. 7 in a stowed location.

In other examples of the invention, the slag removal process may be accomplished with a slag skimmer tool, which is suitably stored in the furnace operating space. In one non-limiting example, as shown in FIG. 7 slag skimmer tool 110 is of a clam shell design comprising first and second shells 112*a* and 112*b* that can be pneumatically or otherwise powered opened and closed. In FIG. 7 the clam shells are shown in the closed position, as they would be after capturing slag between the shells as further described below. If the clam shells are formed from a material not sufficient to withstand heat deformation when dipped into a furnace bath, the slag skimmer tool may be stowed with the surfaces of the clam shells submerged in a slurry bath 98 in bath container 120 as shown in FIG. 8. The slurry comprises a heat resistant composition, such as graphite based semisolid composition, so that at least the surface areas of the clam shells that are dipped into the furnace bath will have a protective heat resistant slurry coating prior to being dipped into the furnace bath to collect slag.

For execution of a slag removal process with slag skimmer tool 110, the following condition states must be true: active furnace at zero tilt angle and lid open.

In manual mode, upon permissive input of a "slag removal" command with the input control device, robotic apparatus 30 executes movements required to grip the slag skimmer tool 110 from its stowed location via the tool's standard interface element 32 situated in heat shield 114 as shown in FIG. 7. The robotic movements are controlled by instructions from the integrated process control system. The robotic apparatus then executes movements required to open the clam shells (if not already open) and dip the slag skimmer tool into the active furnace bath to collect slag material between the clam shells by closing the claim shells. For example compressed air may be supplied from robotic apparatus 30 to pneumatic cylinders suitably mounted on the slag skimmer tool via the robotic standard interface element 32 on the slag skimmer tool. The robotic apparatus then executes movements required to remove the slag skimmer tool from the bath to a slag removal location. In some examples of the invention, the slag removal location may be a slag cart similar to that described above, or an opening in the floor of the furnace operating space that opens to a slag pit. The robotic apparatus can then execute movements to return the slag skimmer tool back to its stowed location, or repeat the slag removal process.

For some slag removal processes, addition of a slag coagulant to the bath in a furnace may be necessary prior to dipping into the bath to gather and capture slag. For these slag removal processes, robotic apparatus 30 may execute the following movements: grip slag coagulant tool 78 stored on apparatus 50; properly position the slag coagulant tool at the bottom of a slag coagulant transport chute, which can optionally be located on apparatus 50, to receive slag coagulant delivered via the chute from outside the furnace operating space to the tool; deposit the slag coagulant on the tool into the bath of the active furnace; and return the slag coagulant tool 78 to its stored position on apparatus 50. After adding the slag coagulant, the robotic apparatus can proceed to begin execution of one of the slag removal processes described above.

In the present non-limiting example of the invention, for manual control (mode) of a bath ground check operation or process, the human operator initiates the grounding check process by a suitable manual input control device, such as a pushbutton on furnace equipment processor 24 that outputs a signal to supervisory processor 28. The supervisory processor can output a signal to robot processor 34 for robotic apparatus 30 to perform a grounding check process as further described below. For a fully automatic check grounding process, signals from the manual input control device are inhibited and supervisory processor 28 controls the check grounding variable states. The check grounding process is executed for the active furnace to determine whether the bath in the furnace is electrically grounded.

For execution of a check grounding process, the following condition states must be true: active furnace at aft zero tilt angle and lid open.

In this non-limiting example of the invention, the bath ground check variable states include the position of grounding probe 72 as the bath ground check process is performed and grounding probe 72 is inserted into the active furnace. The ground probe includes electric connections from the probe to its standard interface element 32 attached to the end of the probe, where the electrical connections make contact with electrical connections in the gripper of robotic apparatus 30 so that when the robotic apparatus grips the grounding probe and inserts it into the bath, the tip of the probe making contact with the surface level of the bath will complete an electrical circuit through the bath and furnace that indicates a proper bath ground.

For execution of a check grounding process, robotic apparatus executes movements required to grip grounding probe 72 on integrated tool and transport apparatus 50, which motions are controlled by instructions from the integrated process control system. The robotic apparatus then executes movements required to dip the gripped grounding probe into the active furnace. For a properly grounded furnace bath, when the tip of the grounding probe makes contact with the surface level of the bath, an electrical circuit is closed, and robot processor 34 can output an appropriate signal to supervisory processor 28, which can then relay the proper bath grounding status to required system components such as a computer video display. The position of the robotic apparatus when the tip of the grounding probe makes contact with the surface level of the bath may be used by the integrated process control system to establish a surface level reference datum that can be used during execution of other furnace melt processes. The integrated process control computer program can include a limit condition on how far the robotic apparatus can dip the tip of the grounding probe into the bath before the control system declares a "no bath ground" condition state and executes one or more program routines based upon a "no bath ground" condition state. For example, electric power to the furnace containing the ungrounded bath may be disconnected and a visual and/or audible alarm may be provided by the control system.

In the present non-limiting example of the invention, for manual control (mode) of a temperature check operation or process, the human operator initiates a temperature check process by a suitable manual input control device, such as a pushbutton on furnace equipment processor 24 that outputs a signal to supervisory processor 28. The supervisory processor can output a signal to robot processor 34 for robotic apparatus 30 to perform a temperature check process as further described below. For a fully automatic temperature check process, signals from the manual input control device are inhibited and supervisory processor 28 controls the temperature check process states. The temperature check process is executed for the active furnace to determine the temperature of the bath in the furnace.

For execution of a temperature check process, the following condition state must be true: active furnace at aft zero tilt angle and lid open.

In this non-limiting example of the invention, the temperature check variable states include the position of a temperature immersion lance. During the temperature check process a temperature probe is inserted onto the temperature immersion lance gripped by the robotic apparatus, which is inserted into the bath of the active furnace. The temperature probe includes electric connections from the probe to the temperature lance in which it is inserted. The electrical connections continue from the lance to the standard interface element 32 connected to the end of the lance, where the electrical connections make contact with electrical connections in the gripper of robotic apparatus 30 so that when the robotic apparatus grips the temperature lance and dips the temperature probe on the lance into the bath, the bath temperature measured by the temperature probe on the lance will be transmitted back to robot processor 34, and the robot processor can output the measured temperature signal to supervisory processor 28, which can then relay the measured bath temperature to required system components.

In manual mode, upon permissive input of a "check bath temperature" command with the input control device, robotic apparatus 30 executes movements required to grip temperature lance 76 on integrated tool and transport apparatus 50, which movements are controlled by instructions from the integrated process control system. The robotic apparatus then executes movements required to insert (see arrow labeled "A" in FIG. 5 for location of lance insertion) the temperature probe immersion lance 76 into the hollow interior of temperature probe 84*a*, which is positioned in the "ready" position on apparatus 50 as further described below. The temperature probe and lance may be, for example, a thermocouple probe and lance available from HERAEUS ELECTRO-NITE. The robotic apparatus then executes movements required to insert the temperature probe on the lance gripped by the robotic apparatus into the active furnace bath for a "measure bath temperature" time period, after which time period, robotic apparatus 30 removes the temperature probe from the bath and can pause for an input from the human operator before disposing of the temperature probe and returning the temperature lance 76 to apparatus 50. The human operator's choice of manual inputs can include "repeat check temperature," "change temperature probe" or "finish check temperature," which can be made at furnace equipment processor 24.

Responsive to a "repeat check temperature" input, robotic apparatus 30 executes programmed movements for dipping the temperature probe on the gripped lance into the active furnace as further described above.

Responsive to a "change temperature probe" input, robotic apparatus 30 executes programmed movements to remove the temperature probe currently on lance 76 and inserting the lance into the hollow interior of a next temperature probe 84*a* in the "ready" position on apparatus 50 as further described below, and dipping the new temperature probe on the lance into the bath of the active furnace. One non-limiting example of a method of removal of a temperature probe on the lance comprises the robotic apparatus executing movements to lay the temperature probe on the lance in the metal sampler and used temperature probe chute 54 and retract the immersion lance from the probe by pulling the lance through notch 54*a* (FIG. 4) at the top of chute 54 to strip the temperature probe from lance 76, which causes the striped probe to slide down chute 54 and out of the furnace operating space.

Responsive to a "finish check temperature" input, robotic apparatus 30 executes programmed movements to remove the temperature probe currently on temperature immersion lance 76, for example, as described above, and return lance 76 to its stored location on apparatus 50.

A supply of temperature probes 84 can be stored on the integrated tool and transport apparatus 50 as illustrated in FIG. 4, FIG. 5 and FIG. 6. One or more suitable sensing devices, such as one or more photoelectric sensors can be appropriately positioned on apparatus 50 so that the following condition states, for example, can be sensed: "low number of temperature probes" on apparatus 50; and "no temperature probes remaining" on apparatus 50. The sensed condition states can be transmitted to supervisory processor 28 for further processing. The stored temperature probes on apparatus 50 are gravity fed down angled slide 60 with a suitable actuator 62 controlling the advancement of one temperature probe to the "ready" temperature probe location at the bottom of slide 60. The temperature probe in the ready position is identified as temperature probe 84*a* in FIG. 5 and FIG. 6. When a "check temperature" or "change temperature probe" input is made, if sensor 85 detects "no temperature probes remaining," the sensor can input a signal to supervisory processor 28 so that the robotic apparatus will be inhibited from attempting movements to insert lance 76 onto a temperature probe until a temperature probe is available at the "ready" position on apparatus 50.

In other examples of the invention, more than one type of temperature probe may be used. In those arrangements a separate supply of each type of temperature probe may be provided on apparatus 50, for example, on separate slides, and either manual or automatic mode selection of the appropriate temperature probe in the "ready" position on the appropriate slide can be made.

In other examples of the invention, in lieu of temperature probes, or in combination therewith, robotic apparatus 30 may execute a temperature check process by gripping a non-contact temperature measuring device and aiming it at the surface of the bath in a furnace to obtain a non-contact temperature measurement of the bath for transmission to supervisory processor 28.

In the present non-limiting example of the invention, for manual control (mode) of a metal sampling operation or process, the human operator initiates a metal sampling operation ot process by a suitable input manual input control device, such as a pushbutton on furnace equipment processor 24 that outputs a signal to supervisory processor 28. The supervisory processor can output a signal to robot processor 34 for robotic apparatus 30 to perform a metal sampling process as further described below. For a fully automatic metal sampling process, signals from the manual input control device are inhibited and supervisory processor 28 controls the metal sampling process states. The metal sampling process is executed for the active furnace to determine the chemistry or quality of the bath in the furnace.

For execution of a metal sampling process, the following condition states must be true: active furnace at zero aft tilt and lid open.

In this non-limiting example of the invention, the metal sampling state variables include the position of a sampler lance. During the metal sampling process a metal sampler is inserted onto the sampler lance gripped by the robotic apparatus, which is inserted into the bath of the active furnace. The metal sampler may be a hollow ceramic structure with one or more flow holes into the hollow interior so that when the metal sampler is dipped into the bath with proper orientation, molten metal will fill the hollow interior and freeze into a metal sample that will be appropriately analyzed.

In manual mode, upon permissive input of a "take metal sample" command with the input control device, robotic apparatus 30 executes movements required to grip metal sampler immersion lance 74 on integrated tool and transport apparatus 50, which movements are controlled by instructions from the integrated process control system. The robotic apparatus then executes movements required to insert the immersion lance into the hollow interior of metal sampler 82*a* in the "ready" position on apparatus 50 as further described below. The metal sampler and lance may be, for example, a metal sampler and lance available from HERAEUS ELECTRO-NITE. The robotic apparatus then executes movements required to insert the metal sampler on the lance gripped by the robotic apparatus into the active furnace bath for a "take metal sample" time period, after which time period, robotic apparatus 30 removes the metal sampler from the bath and delivers the metal sampler that contains the metal sample from the furnace operating space. One non-limiting example of delivering the metal sampler from the furnace operating space comprises the robotic apparatus executing movements to laying metal sampler on the lance in the metal sampler and used thermocouple probe chute 54 and retract the immersion lance from the probe by pulling the lance through notch 54*a* (FIG. 4) at the top of chute 54 to strip the metal sampler from lance 74, which causes the striped metal sampler to slide down chute 54 and out of the furnace operating space. FIG. 5 illustrates metal sampler 82*b* positioned in chute 54 after being stripped from lance 74 but before sliding down the chute. After stripping the metal sampler from the lance, robotic apparatus 30 executes movements to return sampler lance 74 back to its stored position on apparatus 50.

Apparatus 50 may include a spring loaded surface in housing 88 to absorb any force exerted by movements of robotic apparatus 30 as it inserts the lance into metal sampler 82*a* in the "ready" position on apparatus 50 to avoid damaging the metal sampler by compression force against otherwise rigid structural element of apparatus 50. Further apparatus 50 may include a rotational indexing mechanism to ensure that the metal sampler in the "ready" position is properly oriented for insertion into the bath by the robotic apparatus if the metal sampler must be properly oriented for filling of the metal sampler with molten metal from the bath.

A supply of metal samplers 82 can be stored on the integrated tool and transport apparatus 50 as illustrated in FIG. 4, FIG. 5 and FIG. 6. One or more suitable sensing devices, such as one or more photoelectric sensors can be appropriately positioned on apparatus 50 so that the following condition states, for example, can be sensed: "low number of metal samplers" on apparatus 50; and "no metal samplers remaining" on apparatus 50. The sensed condition states can be transmitted to supervisory processor 28 for further processing. The stored metal samplers on apparatus 50 are gravity fed down angled slide 64 with a suitable actuator 66 controlling the advancement of a metal sampler to the "ready" metal sampler location at the bottom of slide 64. The metal sampler in the ready position is identified as metal sampler 82*a* in FIG. 5 and FIG. 6. When a "take metal sample" input is made, if sensor 89 detects "no metal samplers remaining," the sensor can input a signal to supervisory processor 28 so that the robotic apparatus will be inhibited from attempting movements to insert lance 74 onto a metal sampler until a metal sampler is available at the "ready" position on apparatus 50.

In some examples of the invention, more than one type of metal sampler may be used. For example wedge metal samplers and metallurgical lab (trim determination) samplers may be used. In those arrangements a separate supply of each type of metal sampler may be provided on apparatus 50, for example, on separate slides, and either manual or automatic mode selection of the appropriate metal sampler in the "ready" position on the appropriate slide can be made.

In some examples of the invention, a spoon metal sampling tool (spoon tool) may be used. The spoon tool may be of a metallurgical foundry ladle design. The spoon tool may be stowed in any suitable location on the integrated tool and transport apparatus 50. In manual mode, upon permissive input of a "take spoon metal sample" command with the input control device, robotic apparatus 30 executes movements required to grip the spoon tool on the integrated tool and transport apparatus, which movements are controlled by instructions from the integrated process control system. When the spoon metal sampling tool is used, the metal sampling state variables can include the position of the spoon metal sampling tool. The robotic apparatus then executes movements required to dip the spoon tool into the active furnace bath to fill the molten metal holder on the spoon tool with a sample of the molten metal in the bath. The robotic apparatus then executes movements required to pour the molten metal from the molten metal holder into a sampling container, which may be, for example, a "quick-cup," "chill cup," or "chill wedge," as known in foundry applications. The solidified molten bath sample in the container may be suitably removed from the foundry operating space.

In other examples of the invention, in lieu of metal samplers, or in combination therewith, robotic apparatus 30 may execute a metal sampling process by gripping a non-contact metal sampling device, such as a spectrometer, and aiming it at the surface of the bath in the furnace to obtain a non-contact analysis of the bath for transmission to supervisory processor 28.

In the present non-limiting example of the invention, for manual control (mode) of an add trim materials process, the human operator initiates an add trim materials process by a suitable manual input control device, such as a pushbutton on furnace equipment processor 24 that outputs a signal to supervisory processor 28. The supervisory processor can output a signal to robot processor 34 for robotic apparatus 30 to perform an add trim materials process as further described below. For a fully automatic add trim materials process, signals from the manual input control device are inhibited and supervisory processor 28 controls the add trim materials process states. The add trim materials process is executed for the active furnace to add trim materials, such as, for example, silicon carbide or iron silicide, to alter the chemistry of the bath in the furnace.

For execution of an add trim materials process, the following condition states must be true: active furnace at zero aft tilt angle and lid open.

In this non-limiting example of the invention, the add trim materials state variables include the position of a trim materials tool in which trim materials are added for deposit into the bath of the active furnace.

For this non-limiting example of the invention, trim materials tool (pan) 79 is stored at the bottom of apparatus 50. Trim materials are placed on trim materials chute 68 outside of the furnace operating space, which causes the trim materials to slide down the chute and onto pan 79. In manual mode, upon permissive input of an "add trim materials" command with the input control device, robotic apparatus 30 executes movements required to grip trim material tool (pan) 78 at its stored position on apparatus 50, with the trim materials on the pan; move the pan to deposit the trim material in the bath of the active furnace; and return the empty pan to its stored position on apparatus 50.

In other examples of the invention, an automated trim materials dispenser that automatically delivers appropriate quantities of different trim materials to the trim materials tool 79 may be used.

Any of the above true/false condition states may be inputted to the integrated control system of the present invention by suitable sensors such as mechanical limit switches, photosensors or other suitable devices. If a condition state is not sensed when required, an error message can be displayed on a suitable output device, such as a computer video display, to indicate the failed condition state.

One non-limiting example of the fully automatic mode of the integrated control system of the present invention in a dual-furnace system is as follows. The human operator selects by a suitable input device, such as a selector switch located on the furnace equipment processor 24, fully automatic mode. Initially all equipment is moved to their respective home positions, if not already in those positions. Program execution in response to an "all home" command is, sequentially: robotic apparatus 30 completes any furnace melt processes that may be being executed at the time that the "all home" command is entered, and returns to the robotic apparatus home position as defined below; the charge cars return to the charge car home positions as defined above; the slag carts return to the slag cart home positions as defined above; and the furnaces return to the furnace home positions as defined above. The "home position" for robotic apparatus 30 is neutral to both furnaces, and for the non-limiting example of the robotic apparatus used in the present invention, all robotic apparatus axes are retracted to their most compact positions.

The human operator may then input a "fully automatic" signal to the integrated process system by a suitable input device, such as a selector switch on the furnace equipment processor 24, which can output the appropriate signal to supervisory processor 28 to assume overall command and control of all processes. In the fully automatic mode of this non-limiting example of the invention, the integrated process control system computer program starts process steps 1 and 2 at the same time.

Process step 1 begins with an empty furnace 20. Furnace 20 is at zero tilt angle and lid 20*a* opens. Then charge car 40 indexes to furnace 20 and begins charging furnace 20 by vibrating (shaking), as described above, to dump charge from the charge car into the furnace. The shaking will take place for periodic on/off time intervals until process step 3 (below) begins; at that time, all equipment associated with furnace 20 return to their home positions.

Process step 2 begins with a bath of molten metal in furnace 22. Furnace 22 back tilts to the aft slag angle and lid 22*a* opens. Then robot processor 34 sends sequential instructions to robotic apparatus 30 to perform furnace melt processes for furnace 22 as follows. The robotic apparatus executes the following processes, as described above, for furnace 22: slag removal process; grounding check process; temperature check process; metal sampling process; and add trim materials process. Upon completion of these processes, all equipment associated with furnace 22 return to their respective home positions. Furnace 22 forward tilts to a pour angle for a "furnace pour" time period and then returns to zero tilt angle.

The bath of molten metal is poured from the furnace into a suitable container, such as a ladle or launderer. Furnace 22 remains at zero tilt angle until process step 3 (below) begins.

Upon completion of process steps 1 and 2, in fully automatic mode of this non-limiting example of the invention, the integrated process control system computer program starts process steps 3 and 4 at the same time.

Process step 3 begins with a bath of molten metal in furnace 20. As mentioned above under process step 1, all equipment associated with furnace 20 return to their home positions at the start of process step 3. Furnace 20 back tilts to the aft slag angle and lid 20*a* opens. Then robot processor 34 sends sequential instructions to robotic apparatus 30 to perform furnace melt processes for furnace 20 as follows. The robotic apparatus executes the following processes, as described above, for furnace 20: slag removal process; grounding check process; temperature check; metal sampling process; and add trim materials process. Upon completion of these processes, all equipment associated with furnace 20 return to their respective home positions. Furnace 20 forward tilts to a pour angle for a "furnace pour" time period and then returns to zero tilt angle. The bath of molten metal is poured from the furnace into a suitable container, such as a ladle or launderer. Furnace 20 remains at zero tilt angle until step 5 (below) begins.

Process step 4 begins with an empty furnace 22. Furnace 22 is at zero tilt angle and lid 22*a* will open. Then charge car 42 indexes to furnace 22 and begins charging furnace 22 by vibrating to dump charge from the charge car into the furnace. The shaking will take place for periodic on/off time intervals until process step 5 begins.

Process step 5 begins with an empty furnace 20 and a bath of molten metal in furnace 22: In the fully automatic mode of this non-limiting example of the invention, the integrated process control system computer program continues execution of a closed loop process sequence comprising above process steps 1 through 4, with execution of the steps as described above, until a program interrupt, such as, for example, the human operator inputting a "manual mode" command, to the integrated process control system by a suitable input device. The program may process such interrupt with an interrupt routine that results in execution of the "all home" routine as described above and an integrated process control system pause for an input command.

In the above non-limiting example of a fully automatic mode of the integrated control system of the present invention, at the start of process steps 1 and 2, furnace 20 is empty and furnace 22 has a bath of molten metal. Appropriate modifications can be made to the above fully automatic process if the states of furnace 20 and 22 are different from those above at the start of process steps 1 and 2.

While in the above examples of the invention, variable furnace states include tilt positions of the furnace, and furnace lid opened or closed, for some furnace process operations, in other examples of the invention, the furnace process may be accomplished with the furnace in the zero tilt position and with the furnace lid closed. For example in some examples of the invention, the furnace lid, or other furnace structure, may include a tool passage opening, preferably a self sealing opening to prevent heat loss through the opening when a tool is not inserted in the opening. The tool passage opening would be of sufficient size so that one or more of the tools could be inserted into the bath with the lid closed and the furnace in the non-tilt position. For example, a grounding probe could be inserted through the opening to execute the bath ground check process as described above, except for the elimination of the conditions that the active furnace be at aft zero tilt angle and lid open. Similarly a sampling spoon could be inserted through the opening to execute a spoon metal sample process as described above, except for the elimination of the conditions that the active furnace be at aft zero tilt angle and lid open. Similarly the temperature probe on a temperature immersion lance could be inserted through the opening to execute a temperature check process as described above, except for the elimination of the conditions that the active furnace be at aft zero tilt angle and lid open. Similarly the metal sampler on a sampler lance could be inserted through the opening to execute a metal sampling process as described above, except for the elimination of the conditions that the active furnace be at aft zero tilt angle and lid open.

While in the above examples of the invention, multiple tools are stored on integrated tool and transport apparatus 50, in other examples of the invention, tools may be stored on individual, or multiple grouped, storage apparatus located in the furnace operating space.

Optionally a clean lens process may be executed by robotic apparatus 30 if one or more photoelectric sensors are used, for example, as described above. The robotic apparatus may execute movements that positions a compressed air feed nozzle located on the robotic apparatus in front of the lens of each photoelectric sensor to release a stream of compressed air for cleaning the lens.

In some examples of the invention, in the automatic mode, the human operator may override execution of the integrated control process system as described above to selectively alter portions of the automatic mode operation. The integrated control process system can continue execution in the automatic mode with the modifications made by the human operator.

Components of other electric induction metal melting furnaces, such as furnaces, charging apparatus, slagging apparatus, robotic apparatus, tools and other implements, tool storage apparatus, transport structures having state variables and/or condition states that differ from those used in the above examples of the invention are within the scope of the present invention when those state variables and/or condition states are controlled by the integrated process control system of the present invention.

The above examples of the invention have been provided merely for the purpose of explanation and are in no way to be construed as limiting of the present invention. While the invention has been described with reference to various embodiments, the words used herein are words of description and illustration, rather than words of limitations. Although the invention has been described herein with reference to particular means, materials and embodiments, the invention is not intended to be limited to the particulars disclosed herein; rather, the invention extends to all functionally equivalent structures, methods and uses. Those skilled in the art, having the benefit of the teachings of this specification and the appended claims, may effect numerous modifications thereto, and changes may be made without departing from the scope of the invention in its aspects.

The invention claimed is:

1. An integrated process control apparatus or installation for an electric induction metal melting foundry comprising:

one or more electric induction melting furnaces located in a contained furnace operating space, each of the one or more electric induction melting furnaces having one or more variable furnace states;

one or more charge delivery installations for delivery of a charge to each one of the one or more electric induction melting furnaces, each of the one or more charge delivery installations having one or more variable charge delivery states;

one or more slag removal installations for removal of a slag from a molten metal bath in each one of the one or more electric induction melting furnaces, each of the one or more slag removal installations having one or more variable slag removal states;

one or more furnace melt process operations comprising a bath ground check, a bath temperature check, a bath metal sampling, and a bath add trim for a process control of the molten metal bath in each one of the one or more electric induction melting furnaces, each of the one or more furnace melt process operations having one or more variable furnace process states;

one or more integrated process control equipment for controlling the one or more variable furnace states, the one or more variable charge delivery states, the one or more variable slag removal states, and the one or more variable furnace process states, the one or more integrated process control equipment located separate from the contained furnace operating space;

an integrated tool and transport apparatus for at least storing one or more tools used in the one or more furnace melt process operations, the integrated tool and transport apparatus located in the contained furnace operating space and one or more robotic apparatus for execution of the one or more furnace melt process operations with the one or more tools, the one or more robotic apparatus located in the contained furnace operating space.

2. The integrated process control apparatus or installation of claim 1 wherein the one or more variable furnace states for each of the one or more electric induction melting furnaces are one or more furnace tilt angle states and a furnace lid opened and closed states.

3. The integrated process control apparatus or installation of claim 1 wherein the one or more charge delivery installations comprise one or more charge cars for delivery of the charge to each of the one or more electric induction melting furnaces and the one or more variable charge delivery states comprise at least an at furnace charge position and a charge supply position of each one of the one or more charge cars.

4. The integrated process control apparatus or installation of claim 1 wherein the one or more slag removal installations comprise:

one or more slag carts and the one or more variable slag removal states comprise at least a slag cart furnace position and a slag cart disposal position of each one of the one or more slag carts; and a slag tool comprising one of the one or more tools stored on the integrated tool and transport apparatus for removal of the slag from the molten metal bath in each of the one or more electric induction melting furnaces by the one or more robotic apparatus and deposit of the slag on the one or more slag carts by the one or more robotic apparatus when the one or more slag carts are in the slag cart furnace position.

5. The integrated process control apparatus or installation of claim 4 wherein the slag tool comprises one or more clam shell slag skimmers.

6. The integrated process control apparatus or installation of claim 1 wherein the bath ground check comprises dipping a grounding probe into the molten metal bath in each of the one or more electric induction furnaces by the one or more robotic apparatus whereby the one or more robotic apparatus completes an electrical circuit to indicate a proper bath ground, the grounding probe comprising one of the one or more tools stored on the integrated tool and transport apparatus, and the one or more variable furnace process states comprises at least a grounding probe position when the grounding probe is transported between the integrated tool and transport apparatus and the molten metal bath by the one or more robotic apparatus.

7. The integrated process control apparatus or installation of claim 1 wherein the bath temperature check comprises dipping a temperature probe into the molten metal bath in each of the one or more electric induction melting furnaces by the one or more robotic apparatus, the temperature probe comprising one of the one or more tools stored on the integrated tool and transport apparatus, and the one or more variable furnace process states comprises at least a temperature probe position when the temperature probe is transported between the integrated tool and transport apparatus and the molten metal bath by the one or more robotic apparatus.

8. The integrated process control apparatus or installation of claim 1 wherein the bath metal sampling comprises dipping a metal sampling tool into the molten metal bath in each of the one or more electric induction furnaces by the one or more robotic apparatus, the metal sampling tool comprising one of the one or more tools stored on the integrated tool and transport apparatus, and the one or more variable furnace process states comprises at least a metal sampling tool position as the metal sampling tool is transported between the integrated tool and transport apparatus and the molten metal bath by the one or more robotic apparatus.

9. The integrated process control apparatus or installation of claim 1 wherein the bath metal sampling comprises dipping a spoon metal sampling tool into the molten metal bath in each of the one or more electric induction furnaces by the one or more robotic apparatus to collect a molten metal sample and pouring the molten metal sample into a sampling container, the spoon metal sampling tool comprising one of the one or more tools stored on the integrated tool and transport apparatus, and the one or more variable furnace process states comprises at least a spoon metal sampling tool position as the metal sampling tool is transported between the integrated tool and transport apparatus, the sampling container and the molten metal bath by the one or more robotic apparatus.

10. The integrated process control apparatus or installation of claim 1 wherein the bath add trim comprises depositing a trim materials on an add trim tool into the molten metal bath in each one of the one or more electric induction melting furnaces by the one or more robotic apparatus, the add trim tool comprising one of the one or more tools stored on the integrated tool and transport apparatus, and the one or more variable furnace process states comprises at least an add trim tool position as the add trim tool is transported between the integrated tool and transport apparatus and the molten metal bath by the one or more robotic apparatus.

11. The integrated process control apparatus or installation of claim 1 wherein the one or more integrated process control equipment comprises:

a robotic apparatus processor controller comprising a computer processing equipment for control of the one or more robotic apparatus;

a robotic apparatus remote controller comprising an operating interface to the one or more robotic apparatus;

a furnace equipment control processor comprising a manual control input for the one or more electric induction melting furnaces, the one or more charge delivery installations, the one or more slag removal installations and the one or more robotic apparatus;

a furnace performance processor comprising a monitoring and control equipment for the electric induction metal melting foundry; and an integrated system supervisory control processor comprising a supervisory computer processing equipment for the integrated process control apparatus or installation.

12. A method of producing a molten metal from one or more electric induction furnaces, the method comprising the steps of:

locating the one or more electric induction furnaces; an integrated tool and transport apparatus and one or more robotic apparatus in a contained furnace operating space:

locating one or more integrated control equipment separate from the contained furnace operating space;

controlling one or more variable furnace states of each one of the one or more electric induction furnaces with at least one integrated process controller comprising at least one of the one or more integrated control equipment to produce the molten metal bath by inductively heating a charge deposited in each one of the one or more electric induction furnaces;

controlling one or more variable charge delivery states of at least one charge delivery installation with the at least one integrated process controller to deliver the charge to each one or more electric induction furnaces;

controlling one or more variable slag removal states of a slag removal installation with the at least one integrated process controller to remove a slag from the molten metal bath in each one of the one or more electric induction furnaces; and controlling one or more robotic apparatus with the at least one integrated process controller to perform one or more furnace melt process operations comprising a bath ground check, a bath temperature check, a bath metal sampling, and a bath add trim by at least transporting a tool stored on the integrated tool and transport apparatus between the integrated tool and transport apparatus and the molten metal bath in each one of the one or more electric induction furnaces.

13. A method of producing a molten metal bath in an electric induction foundry from a first electric induction melting furnace and a second electric induction melting furnace; an integrated tool and transport apparatus and a robotic apparatus in a contained furnace operating space, the robotic apparatus being non-ambulatory and having an articulated arm with six degrees of freedom and a gripper hand, and an integrated process control equipment located separate from the contained furnace operating space, the method comprising the steps of:

(a) positioning the first electric induction melting furnace in a zero tilt angle variable furnace state and a furnace lid open variable furnace states;

(b) indexing a first charge car in a first charge delivery installation to a first furnace charge delivery position to deposit a first charge on the first charge car to the first electric induction melting furnace;

(c) positioning the second electric induction melting furnace having a second molten metal bath in an aft tilt angle variable furnace state and the furnace lid opened variable furnace state;

(d) executing an at least one furnace melt process operation with the robotic apparatus by engaging the gripper hand with one or more tools stored on the integrated tool and transport apparatus for the at least one furnace melt process operation and transporting in the gripper hand the one or more tools for the at least one furnace melt process operation between the integrated tool and transport apparatus and the second molten metal bath in the second electric induction melting furnace, the at least one furnace melt process operation comprising a slag removal process, a ground check process, a temperature check process, a metal sampling process and an add trim process for the second molten metal bath with the second electric induction melting furnace in the aft tilt angle variable furnace state and the furnace lid opened variable furnace state with the integrated process control equipment controlling one or more variable process states of the at least one furnace melt process operation;

(e) positioning the second electric induction melting furnace having the second molten metal bath in a pour angle variable furnace state and the furnace lid opened variable furnace state to pour the second molten metal bath from the second electric induction melting furnace for a second furnace pour time period and positioning the second electric induction melting furnace in the zero tilt angle variable furnace state and the furnace lid opened variable furnace state at the end of the second furnace pour time period;

(f) positioning the first electric induction melting furnace having a first molten metal bath in the aft tilt angle variable furnace state and the furnace lid opened variable furnace state;

(g) executing the at least one furnace melt process operation for the first molten metal bath with the first electric induction melting furnace in the aft tilt angle variable furnace state and the furnace lid opened variable furnace state, the robotic apparatus engaging the gripper hand with one or more tools stored on the integrated tool and transport system for the at least one furnace melt process operation and transporting in the gripper hand the one or more tools for the at least one furnace melt process operation between the integrated tool and transport apparatus and the first molten metal bath in the first electric induction melting furnace, with the integrated process control equipment controlling one or more variable process states of the at least one furnace melt process operation;

(h) positioning the first electric induction melting furnace having the first molten metal bath in the pour angle variable furnace state and the furnace lid opened variable furnace state to pour the first molten metal bath from the first electric induction melting furnace for a first furnace pour time period and then positioning the first electric induction melting furnace to the zero tilt angle variable furnace state and the furnace lid opened variable furnace state at the end of the second furnace pour time period; and (i) indexing a second charge car in a second charge delivery installation to a second furnace charge delivery position to deposit a second charge on the second charge car to the second electric induction melting furnace.

* * * * *